United States Patent [19]

Shor

[11] Patent Number: 4,895,626

[45] Date of Patent: Jan. 23, 1990

[54] PROCESS FOR REFINING AND PURIFYING GOLD

[76] Inventor: Peter S. Shor, 230 E. 15th St., New York, N.Y. 10003

[21] Appl. No.: 338,788

[22] Filed: Apr. 14, 1989

[51] Int. Cl.[4] ..... C25C 1/20

[52] U.S. Cl. ..... 204/111

[58] Field of Search ..... 204/109, 111

[56] References Cited

U.S. PATENT DOCUMENTS 1,996,985 4/1935 Truthe ..... 204/57

3,663,388 5/1972 Hedman ..... 204/146

4,612,093 9/1986 Shor ..... 204/111

*Primary Examiner*—T. M. Tufariello

*Attorney, Agent, or Firm*—Wolder, Gross & Yavner

[57] ABSTRACT

A process for purifying and refining gold to 98+% purity is dislosed. The gold to be refined is made the anode in an electrolytic cell with a solution of ammonium chloride as the electrolyte. The purified gold is collected in anode bags and the non-gold impurities including silver are dissolved in the electrolyte. The silver is complexed with the ammonium ion in the electrolyte.

10 Claims, No Drawings

PROCESS FOR REFINING AND PURIFYING GOLD

This invention relates to the refining and purification of karat gold to 98% purity. More particularly, it relates to a novel process, to a novel electrolyte and to a novel electrolytic cell apparatus and components for this process.

BACKGROUND OF THE INVENTION

Crude gold arrives on the market in ingot form from various sources.

Primary sources are golds recovered from ores by conventional and established methods, such as the amalgamation process by the cyanide process and by the chlorine process. The gold extracted and isolated by these processes is then refined by electrolysis of these golds from chloride or cyanide solutions. The gold recovered at the cathodes is usually deposited on foils. The gold recovered from the cathodes is then melted and cast into the gold ingots. The purity of this commercial ingot gold is about 96%. It contains the usual trace elements associated with gold ores such as copper, silver, arsenic and nickels.

Secondary gold sources are the recycled industrial gold wastes from castings or machine turnings such as spatters, sprues, trimmings, polishings, rejected castings and quality control rejects of electronic parts. Such secondary or recycled industrial golds contain the various alloying metals and elements used by the jewelry and other gold generating trades. These include the various coloralloying metals as well as hardening elements or melt additives for the alloys.

The trace elements and the various alloying metals must be removed before gold can be properly re-used. Various separating and refining methods have been proposed and some are still in active use.

In all cases the primary and secondary golds are melted and cast into "crude ingots". These crude ingots contain from up to 98% gold.

The method for gold refining generally used, called the "mint method" because of their primary user, consists in electrolyzing the crude ingots as gold anodes in hot acidic solutions, initially containing 7–8% gold chloride and 10% hydrochloric acid. Current densities as high as 110 amps/ft$^2$ of cathode surface are used and the refined gold is electrodeposited unto foil or rolled sheet gold cathodes. The gold deposited is "mint" grade, 98.5% purity. The electrolysis cells used at the mints and assay offices are generally constructed to specification of glazed porcelain or chemical stoneware, During the mint electrolysis, platinum and palladium, often present, remain in solution in the haloacidic electrolyte. The halides in the electrolyte precipitate any silver from the alloys as silver chloride. To prevent reduction of any silver particles in proximity of the cathode onto the cathode, it is the practice to surround the anodes with permeable bags usually of nylon cloth. This anode bagging is practiced to confine the insoluble AgCl away from the cathode. At periodic intervals, because of the accumulation of electrolyte-insoluble "dross" impurities, the bags are changed. The impurities isolated within the anode bags are the heavy silver chloride at the bottom of the bags and the floating lighter scum or "dross", mainly of mixed silicates, and borates; and arsenic and antimony complexes in silicroborate form. This dross can be skimmed off or separated before a silver recovery procedure. The AgCl in the bags is usually recovered after removal of the bags by complexing and dissolving with cyanide or ammonium hydroxide solutions in which the dross compounds are insoluble. Some of the electrolyte is withdrawn from the cell for purification and replaced with fresh solutions of acid and gold chloride.

The gold ions pass thru the permeable bags to deposit on the cathode.

In my previous patent, SHOR U.S. Pat. No. 4,612,093, I describe an inexpensive process and apparatus for purification of karat gold, i.e. alloyed gold usually from secondary sources. Karat gold in the jewelry trade is gold alloyed with other alloying metals for hardening, coloring or other jewelry desired qualities. In this process the karat gold is electrolyzed from karat gold anodes in an "impregnated" salt water solution against inert cathodes. The gold ions are confined away from the cathodes by a semi-permeable membrane and accumulate in the electrolyte. The confined electrolyte is periodically withdrawn from the electrolytic cell and the gold ions are selectively reduced by chemical means. As this process does not utilize or generate toxic chemicals or gases, it can be practiced in a simple apparatus. No hoods or special ventilating systems are needed. It is very useful for operation by jewelers or in small plants. Recovery of the other elements including silver, copper, zinc is provided by my process.

Another process disclosed by TRUTHE in U.S. Pat. No. 1,996,985, describes another method for purification of karat gold. TRUTHE's method involves the purification of karat gold by electrolytically leaching from the scrap anodes, the non-gold metallic (copper, zinc, silver, nickel and platinum metals). A nitrate electrolyte of $Cu(NO_3)_3$ and dilute nitric acid is used for this electroleaching. The gold and platinum metals are insoluble in this leaching electrolyte and are collected in bags as anode slime. The non-gold metallics such as silver and copper are soluble in this nitrate electrolyte. Depending on the electropotential used, the silver and nickel metals deposit on the cathode and the other non-gold metals remain dissolved in the electrolyte, and if desired are recovered therefrom.

A method has also been disclosed in U.S. Pat. No. 3,663,388 for peeling pure gold from scrap gold contacts used in the electronic industry and also for masked etching and/or removal from electronic circuit boards. The gold is electrolyzed and peeled to from a non-adherent gold "oxide" in aqueous inorganic salt solutions. The non-adherent pure gold is removed from the substrate, by vibration and recovered in its pure form. No purification from alloying elements is involved as the gold used for electronic circuitry is essentially pure gold.

BRIEF DESCRIPTION OF THE INVENTION

It is an object of this invention to provide an electrolytic method for parting impure gold into pure gold and into its impurities either as electrolyte solutions or electrolytic cathode deposits thereof.

It is a further object of this invention to provide a method for electro-formation of compacted impure gold into finely divided purified gold.

It is still a further object of this invention to provide an electrolyte in which metallic gold can be subdivided, as mentioned above, and in which the non-gold metals and impurities remain dissolved and/or complexed in solution.

It is another object of this invention to provide an electrolyte for the above described process wherein any copper or silver impurities from the karat gold are complexed so as not to precipitate in the presence of any chloride ions of the electrolyte or derived from anode-included impurities.

The above and ancillary objects such as lack of toxicity in the practice of the process or safety of the electrolyte will be apparent from practice of the invention as described.

My present invention is directed to a method for refining impure golds including karat gold by the electrolyzing of gold-containing anodes in a selective electrolyte in which the non-gold elements are selectively dissolved and the pure gold is disintegrated into a finely divided metallic state. The finely divided pure gold, freed from contaminant metals, is segregated from the electrolyte, in which the contaminants are contained.

This segregated gold in finely divided form is of greater than 98% purity. The gold contaminating alloying elements are dissolved by the applied electropotential and remain dissolved in said electrolyte until recovered therefrom, if desired, either by chemical isolation or electrolytic cathodic deposition.

The selective electrolyte useful in the process of this invention comprises electroconductive salts and include therein a source of ammonium ion, in concentration sufficient, under the electrolytic conditions within the cell, to complex with any silver to form the silver-ammonium complex ion. This silver-ammonium complex ion remains soluble in said electrolyte even in the presence of chlorides or other halide ions in said electrolyte.

By converting any and all silver present from the anode into the soluble silver-ammonium complex, contamination of the pure particulate gold with silver or i.e. silver chloride is avoided. The electrolyte should preferably be maintained at a pH in the range 3.0 to 7.5. At pH above this range there may be problems maintaining sufficient ammonium ion in solution and of forming insoluble hydroxides of some of the common alloying metals such as copper, nickel and zinc. At low pH ranges there is evidence of formation of some soluble auric chloride complexes. Such soluble gold complexes reduce the yield of recovered and refined gold unless special chemical recovery procedures for dissolved gold are instituted. (Such chemical recovery procedures are discussed in my previous patent.

It should be noted that the present invention differs from my aforesaid U.S. Pat. No. 4,612,093. In that invention the gold is dissolved as auric chloride from the anode, whereas in the present invention, the gold is directly precipitated from the anode. The electrolyte of my previous invention is impregnated with an oxidizing agent for promoting the formation of the gold solution, whereas the present electrolyte contains no such impregnating agent and the gold is not soluble therein. In my previous invention the silver was precipitated in the anode compartment as silver chloride, whereas in the present invention, all the silver is complexed and dissolved in the electrolyte and diffuses from the anode compartment. In my previous invention the gold solution formed in the anode compartment is segregated therein by the semipermeable membrane, but in the present invention no solution is formed, but the purified gold is precipitated as a particulate solid and is confined as the anode, whereas all the non-gold elements are dissolved in the electrolyte which diffuses and circulates away from the anode through the permeable anode bag by the influence of the EMF.

DETAILED DESCRIPTION OF THE INVENTION

The method of this invention can be performed in standard electrolytic cells such as used in the laboratory or for commercial refining. The Wohwill cell used for gold refining is satisfactory. The cell is confined to vessels of any of the materials usually used for gold refining, including glass jars, fiberglass or glass lined tanks, plastic vessels and even the old-fashioned wooden tanks provided with acid resistant linings of rubber or asphalt.

The anode bags may be made of the standard nylons used for gold refining including nylon 66, or they can be made of corrosion resistant woven fabrics ranging from polyesters to cottons, Some of the non-woven fabrics presently is use that are permeable to liquids and dissolved ions may also be used as anode bags.

The anode bags preferably should fit the anodes with sufficient room for circulation of the electrolyte to the anode surface but initally tighter fits of the bag to the anodes will also serve as the anodes crepitate under the influence of the electrolytic current. The solids of the anode are converted to the insoluble gold powder and the dissolved, ionized or complexed metals. The anode bags should have a sufficiently fine mesh as to enclose or confine the gold "slime" or powder. Choice of the mesh of the fabric is a matter of experience depending upon the potential in the cell, the current density and the temperature of the electrolyte. Present commercial anode bags are satisfactory.

It is useful in the practice of the invention to maintain the temperature of the electrolyte below its boiling point to maintain high current density operations and to prevent loss of ammonia or ammonium chloride from the electrolyte. The latter has an appreciable vapor pressure. Heat exchangers are useful for controlling the temperature.

The preferred electrolyte for the practice of this invention must contain an appreciable amount of ammonium ion. Other ions may be present to ensure high conductivity in the cell, including alkali metal cations and various anions from acids that ionize to provide high conductivity. However, the electrolyte must contain sufficient ammonium ions to complex any and all silver from the crude gold anodes, particularly those from karat gold. One molar ammonium chloride is adequate as a starting concentrate, but as the source of ammonium ions in the electrolyte is depleted by the complexing of the silver from insoluble silver chloride, additional ammonia or ammonium ion sources may be added. Ammonia water or ammonium hydroxide solution are convenient sources, but solid ammonium chloride can be added as well.

Under the influence of the electromotive forces in the cell, an electrolyte such as sodium chloride dissolves all the metallic values of karat gold except silver and gold. The silver in the presence of chloride ions, forms insoluble silver chloride.

Ammonium hydroxide will dissolve silver chloride by forming soluble ammonium silver complexes, wherein the dissolved complexes have such low ionization potentials as to keep the silver from forming or remaining as insoluble silver chloride.

Thus by maintaining a sufficient concentration of ammonium ions and an EMF in the cell, even the appreciable silver content of karat gold is dissolved in the electrolyte leaving behind the insoluble gold.

As the alloying matrix of karat gold is dissolved by the influence of the electrolytic current, the gold forms a fine powder with precipitates from the anode surface and collects in the anode bags as gold "slime". The soluble ions and complexed (silver and copper) remain in the electrolytes. The bags are frequently changed and the gold is recovered in pure form.

Since both ammonium and chloride ions, in various combinations as long as sufficient ammonium ion is present, will electrolyze karat and other cude gold anodes, any combination of these two ions and other non-precipitating salts or ions will work as the electrolyte in the present invention.

I have found that there may be added to the electrolyte, essentially consisting of dissolved ammonium chloride, such ionizing sources as sodium chloride, potassium chloride, hydrochloric acid, ammonium carbonate, ammonium hydroxide, ammonium tartrate, etc. These may be added to replenish the amount of available ammonium ion during electrolysis, or to improve the conductivity of the electrolyte during operation of the cell.

It is preferred to maintain the pH of the electrolyte in the cell in the range 3.5 to 7.5. Below the lower value, the buffering effect of the ammonium ion to form the complex is reduced and above the pH the basic conditions in the solvent precipitate the non-precious metals as hydroxides. These hydroxides if precipitated at the anode will contaminate the gold slime in the anode bags.

Surprisingly, though ammonium hydroxide is a relatively strong base, in the practice of this invention, ammoniums serve as a buffering agent to maintain the pH within preferred limits during the operation of the cells.

It has been observed in exploring the limits of this invention, that ammonium hydroxide will complex and dissolve the primary non-gold components of karat gold such as silver and copper but such an electrolyte is not preferred due to the difficulty in maintaining the solubility of other components such as nickel. In addition, the ammonium hydroxide electrolyte has two major drawbacks. The first is its strong pungency making it fairly obnoxious and unsafe to use in confined quarters. Secondly, the conductivity of ammonium hydroxide solution is much lower than that of mixed salt solutions. Electrolizing karat gold solely in an ammonium hydroxide solution is much slower that in ammounium chloride solutions or in combinations of ammonium chloride and sodium chloride.

The gold power as washed from the anode bags is of excellent purity 98% + and usually above 99%. The washing of the bulk of the gold from the bags is by conventional methods and the bags are then recycled. Periodically, the bags are burned and any gold residues are recovered therefrom.

The electrolyte, containing the non-gold components of the crude anode, is recovered by conventional procedures for the faluable silver complexed therein and depending upon the market for any of the other alloying metals such as nickel, copper etc.

The invention will be further described in conjunction with the following example illustrating the practice thereof. It is understood that this is merely examplary and is not to limit the invention beyond any art-recognized equivalents thereof.

EXAMPLES

A nominal recovered 14K gold anode from the jewelry trade, consists of about 58% gold, 36% copper and 5% silver, was electrolyzed in a molar aqueous solution of ammonium chloride. The pH of the electrolyte solution was about 5.5–6.0. The anode was enclosed within a nylon anode bag and a potentioal of 10 to 15 volts was applied under the 14K anode was substantially completely electrolyzed. The powdered gold was washed from the anode bag and assayed. It was found to be 98.7 to 99.3% gold. The impurities in this refined gold were 0.3 to 1.0% silver, 0.1 to 0.2% silicon and copper and less than 0.005% each of platinum, boron, palladium, manganese, tin, nickel, bismuth and chromium. Thus the recovered gold was considered purer than "mint grade" and suitable for re-use in the jewelry trade.

Thus, my invention provides a simple method for gold recovery and purification that can be safely performed without corrosive, caustic or toxic electrolytes. The method utilized conventional equipment but requires no special precautions such as protection from cyanides or other pungent and toxic fumes and materials. It can be practiced in locales such as divergent as jewelers shops, assay offices and large scale refineries.

What is claimed:

1. A method for electrorefining gold which comprises the steps of preparing an electrolytic cell including an anode, a cathode and an electrolyte.;

forming the anode from the gold-containing metal to be refined;

encasing said anode in a permeable anode bag to form an anode assembly;

filling the cell with an aqueous solution of electroconductive salts, at least one of said salts being a source of ammonium ions, said ammonium ions maintained in said electrolyte in concentrations sufficient to form soluble complexes with any silver in said gold-containing metal under the electrolytic conditions in said cell;

said electrolyte maintained at a pH sufficiently low to prevent precipitation of any non-gold hydroxides;

imposing a voltage potential between the anode and cathode of said cell sufficient to solubilize substantially all the non-gold components of said anode and remove same from said anode bag and to subdivide the insoluble gold content of said gold-containing metal into pure particulate gold; and collecting the pure insoluble gold particles accumulated within the anode bag.

2. The method according to claim 1 wherein the source of ammonium ions is dissolved ammonium chloride.

3. The method according to claim 2 wherein said electrolyte has additional conductivity enhancing salts added thereto.

4. The method according to claim 3 wherein said conductivity enchancing salts include sodium chloride.

5. The method according to claim 1 wherein the source of gold-containing metal is karat gold from jewelry, jewelry casting wastes, turnings and semi-refined ores.

6. The method according to claim 5 wherein said metals include karot gold containing silver and/or copper as alloying elements.

7. The method according to claim 1 wherein said anode enclosing bags are made of electrolyte-resistant woven and non-woven electrolyte permeable materials.

8. The method according to claim 1 wherein the pH of the electrolyte is in the range 3.5 to 7.5.

9. The method according to claim 1 wherein said electrolyzing potential is in the range 10 to 15 volts.

10. The method according to claim 1 wherein the particulate gold is recovered from said anode bags by washing therefrom and has a purity of at least 98.5.%.

* * * * *